US010998647B2

(12) United States Patent
Kameda et al.

(10) Patent No.: US 10,998,647 B2
(45) Date of Patent: May 4, 2021

(54) HARNESS WITH A WIRE TERMINAL

(71) Applicant: Japan Aviation Electronics Industry, Ltd., Tokyo (JP)

(72) Inventors: Kenji Kameda, Tokyo (JP); Kazuomi Sato, Tokyo (JP); Kenji Yamazaki, Tokyo (JP); Hayato Nakamura, Tokyo (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 0 days.

(21) Appl. No.: 16/609,855

(22) PCT Filed: May 11, 2018

(86) PCT No.: PCT/JP2018/018264
§ 371 (c)(1),
(2) Date: Oct. 31, 2019

(87) PCT Pub. No.: WO2018/221161
PCT Pub. Date: Dec. 6, 2018

(65) Prior Publication Data

US 2020/0083616 A1 Mar. 12, 2020

(30) Foreign Application Priority Data

May 29, 2017 (JP) ..... JP2017-105558

(51) Int. Cl.
*H01R 4/18* (2006.01)
*H01R 13/11* (2006.01)
*H01R 13/42* (2006.01)

(52) U.S. Cl.
CPC ..... *H01R 4/185* (2013.01); *H01R 13/11* (2013.01); *H01R 13/42* (2013.01)

(58) Field of Classification Search
CPC ..... H01R 4/185; H01R 13/11; H01R 13/42
(Continued)

(56) References Cited

U.S. PATENT DOCUMENTS 8,192,222 B2 * 6/2012 Kameyama ..... H01R 9/03 439/404
8,414,329 B2 * 4/2013 Morikawa ..... H01R 4/185 439/578
(Continued)

FOREIGN PATENT DOCUMENTS

JP 2011-198514 A 10/2011
JP 2011-216395 A 10/2011
(Continued)

OTHER PUBLICATIONS

International Search Report dated Jul. 17, 2018 in corresponding International Application No. PCT/JP2018/018264; 4 pages.
(Continued)

*Primary Examiner* — Harshad C Patel
(74) *Attorney, Agent, or Firm* — Maier & Maier, PLLC

(57) ABSTRACT

A wire includes a core wire, an insulating coating that covers an outer periphery of a non-distal end region as a part of the core wire other than the distal end region, and a distal end seal part that is disposed separately from the insulating coating and seals the distal end part of the distal end region of the core wire. The core wire is exposed between the distal end seal part and the insulating coating. The distal end seal part includes a tubular distal end cover part that covers an outer periphery of the distal end part and a welded part that is crushed in an orthogonal direction orthogonal to a wire direction and is closed by welding.

9 Claims, 22 Drawing Sheets

(58) Field of Classification Search
USPC ..... 439/877, 850–855
See application file for complete search history.

(56) References Cited

U.S. PATENT DOCUMENTS

| | | | | |
|---|---|---|---|---|
| 9,350,109 | B2 * | 5/2016 | Ohnuma | H01R 4/184 |
| 9,865,965 | B2 * | 1/2018 | Enomoto | H01R 11/12 |
| 2011/0225820 | A1 * | 9/2011 | Kondo | H01R 43/048 29/863 |
| 2012/0142233 | A1 * | 6/2012 | Blasko | H01R 13/113 439/852 |
| 2012/0329341 | A1 * | 12/2012 | Morikawa | H01R 13/114 439/866 |
| 2012/0329342 | A1 * | 12/2012 | Sato | H01R 4/184 439/866 |
| 2012/0329343 | A1 | 12/2012 | Sato et al. | |
| 2014/0154915 | A1 * | 6/2014 | Ohnuma | H01R 4/62 439/587 |
| 2014/0235117 | A1 * | 8/2014 | Sato | H01R 43/048 439/877 |
| 2016/0126642 | A1 * | 5/2016 | Tonoike | H01R 43/0221 439/877 |
| 2017/0025769 | A1 * | 1/2017 | Tokunaga | H01R 4/188 |

FOREIGN PATENT DOCUMENTS

| | | | |
|---|---|---|---|
| JP | 2013-105583 | A | 5/2013 |
| JP | 5418332 | B2 | 2/2014 |
| JP | 2014-160595 | A | 9/2014 |
| WO | 2011/115004 | A1 | 9/2011 |

OTHER PUBLICATIONS

Japanese Office Action dated Jul. 10, 2018 in corresponding Japanese Application No. 2017-105558; 10 pages; Machine-generated translation attached.
Japanese Office Action dated Feb. 26, 2019 in corresponding Japanese Application No. 2017-105558; 8 pages; Machine-generated translation attached.
European Partial Search Report dated May 19, 2020, in corresponding European patent application No. 18809501.2, 14 pages.

* cited by examiner

HARNESS WITH A WIRE TERMINAL

FIELD

The present disclosure relates to a wire, a wire with a terminal, a harness, and a method of manufacturing a wire.

BACKGROUND

Japanese Patent No. 5418332 discloses a wire with a terminal fitting 102 in which a female terminal fitting 101 is attached to an aluminum wire 100 as shown in FIG. 21 of the present application. The aluminum wire 100 includes a core wire 103 and an insulating coating 104. The core wire 103 is composed of a stranded wire obtained by twisting a plurality of element wires made of aluminum or an aluminum alloy. The insulating coating 104 is made of a synthetic resin and covers an outer periphery of the core wire 103. The female terminal fitting 101 is formed by pressing a plate made of a copper alloy. When the core wire 103 of the aluminum wire 100 and the female terminal fitting 101 are made of metals dissimilar from each other, the core wire 103 may be dissolved due to known galvanic corrosion. In order to solve this problem, in Patent Literature 1, the above galvanic corrosion is prevented by a resin cap 105 covering the core wire 103 that is exposed in a state in which the female terminal fitting 101 is attached to the aluminum wire 100. The resin cap 105 is obtained by heat-welding a separate coating, which has been separated by peeling the insulating coating 104.

SUMMARY

However, Japanese Patent No. 5418332 does not describe how to heat-weld the separate coating.

An object of the present disclosure is to provide a technique for reliably sealing a distal end part of a core wire.

A first example aspect of the present disclosure is a wire including: a core wire; an insulating coating that covers an outer periphery of a part of the core wire other than a distal end region; and a distal end seal part that is disposed separately from the insulating coating and seals a distal end part of the distal end region of the core wire. The core wire is exposed between the distal end seal part and the insulating coating, the distal end seal part includes: a tubular distal end cover part that covers an outer periphery of the distal end part; and a welded part that is crushed in a cross direction crossing a longitudinal direction of the wire and is closed by welding.

Preferably, a center of gravity of a cross section, which is orthogonal to the longitudinal direction of the wire, of the welded part is offset from a center of gravity of a cross section, which is orthogonal to the longitudinal direction of the wire, of the distal end cover part.

Preferably, a shape of the cross section, which is orthogonal to the longitudinal direction of the wire, of the welded part is a U-shape or a V-shape.

Preferably, the welded part is formed to avoid a virtual extension line of a central axis of the core wire.

Preferably, the cross direction is a direction orthogonal to the longitudinal direction of the wire.

Preferably, a wire with a terminal includes: the wire; and a terminal attached to the wire. The terminal includes: an electrical contact part electrically contactable with a mating terminal; a wire crimp part that is crimped to the wire; and a connecting part that connects the electrical contact part to the wire crimp part. The wire crimp part includes a pair of crimp pieces each being crimped to the distal end cover part of the distal end seal part, the core wire exposed between the distal end seal part and the insulating coating, and the insulating coating, thereby sealing the exposed core wire, or the wire crimp part is tubular and crimped to the distal end cover part of the distal end seal part, the core wire exposed between the distal end seal part and the insulating coating, and the insulating coating, thereby sealing the exposed core wire.

Preferably, when the wire crimp part is viewed from the electrical contact part along the longitudinal direction of the wire, a center of gravity of a cross section, which is orthogonal to the longitudinal direction of the wire, of the welded part is positioned between a center of gravity of a cross section, which is orthogonal to the longitudinal direction of the wire, of the distal end cover part and the connecting part.

Preferably, the electrical contact part includes: a contact spring piece contactable with the mating terminal; and a spring protector that accommodates and protects the contact spring piece, and a distal end of the welded part is positioned between a distal end and a rear end of the spring protector.

Preferably, the spring protector has a rectangle tubular shape including a base plate part connected to the connecting part, two side plate parts, and a top plate parts opposed the base plate part, and a dimension from the distal end of the spring protector to a rear end of the top plate part is smaller than a dimension from the distal end of the spring protector to rear ends of the two side plate parts.

Preferably, at least a part of the core wire is positioned above the connecting part between the electrical contact part and the wire crimp part.

Preferably, a harness includes: the wire with a terminal; and a housing that accommodates the terminal. The housing includes a retainer contactable with the rear end of the spring protector in the longitudinal direction of the wire.

A second example aspect of the present disclosure is a method of manufacturing a wire including: a step of cutting an insulating coating that covers a core wire to thereby separate the insulating coating into a first insulating coating that covers a distal end region of the core wire and a second insulating coating that covers a part of the core wire other than the distal end region; a step of moving the first insulating coating in a direction away from the second coating to thereby expose the core wire between the first insulating coating and the second insulating coating; crushing an excess part, which is a part of the first insulating coating other than a part covering an outer periphery of the core wire in a cross direction crossing a longitudinal direction of the core wire; and closing the crushed excess part by welding.

Preferably, the step of crushing and the step of closing are executed at the same time.

According to the present disclosure, it is possible to reliably seal the distal end part of the core wire.

DETAILED DESCRIPTION

First Embodiment

Hereinafter, a first embodiment will be described with reference to FIGS. 1 to 19C.

Figure 1:
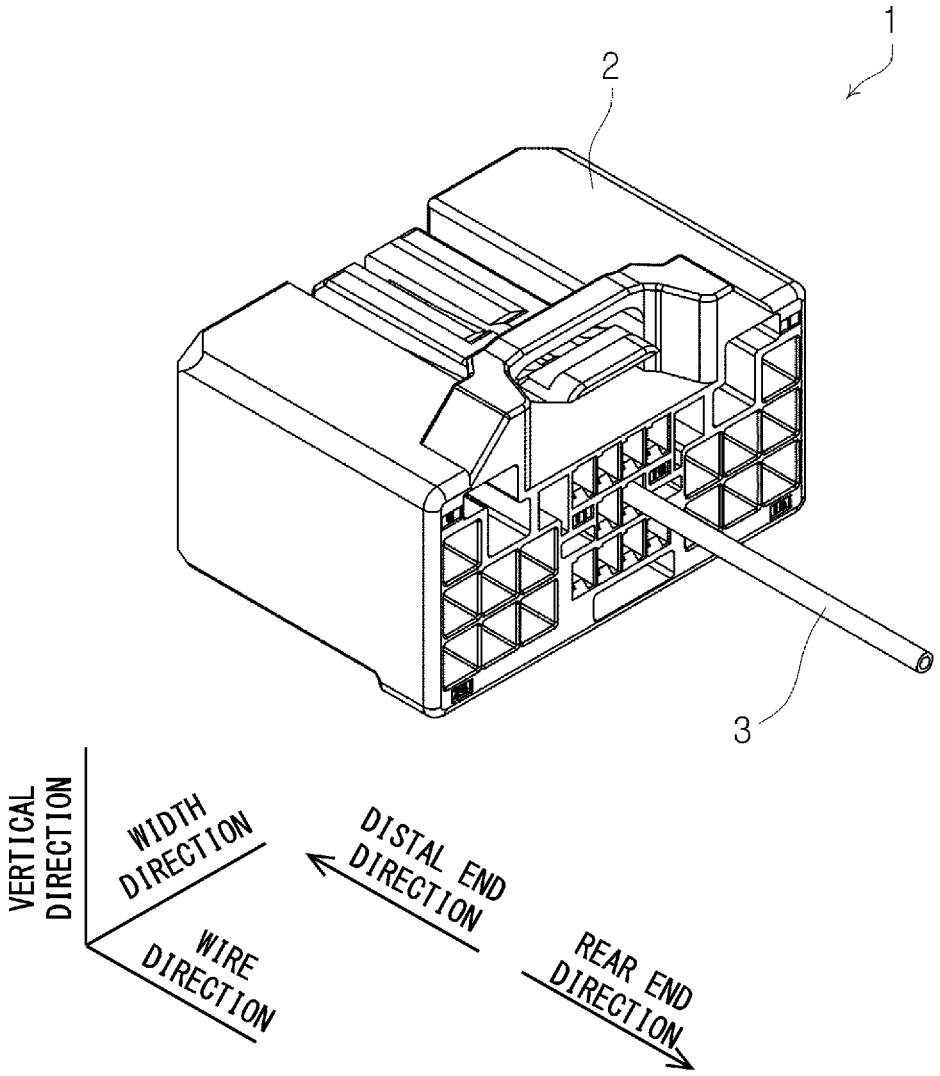
FIG. 1 is a perspective view of a harness (first embodiment)

FIG. 1 is a perspective view of a harness 1. As shown in FIG. 1, the harness 1 includes a housing 2 made of an insulating resin, and a plurality of wires with a terminal 3 accommodated in the housing 2. In FIG. 1, only one wire with a terminal 3 is shown among the wires with a terminal 3, and other wires with a terminal 3 are not shown.

Figure 2:
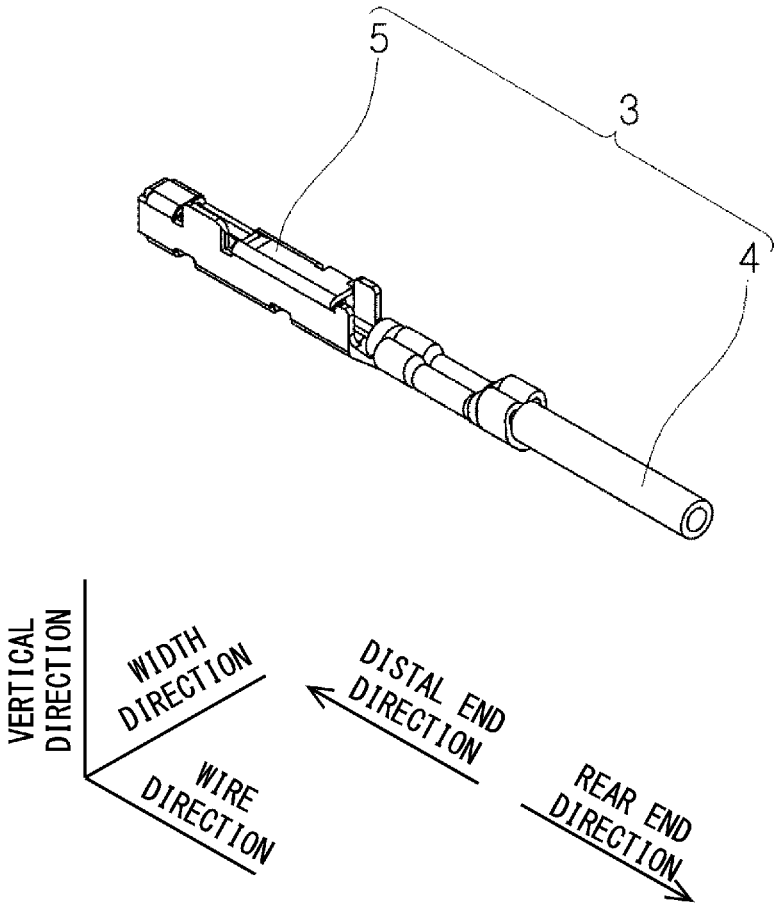
FIG. 2 is a perspective view of a wire with a terminal (first embodiment)

FIG. 2 is a perspective view showing the wire with a terminal 3. As shown in FIG. 2, the wire with a terminal 3 includes the wire 4 and a terminal 5 attached to the wire 4.

<Wire 4>

Figure 3:
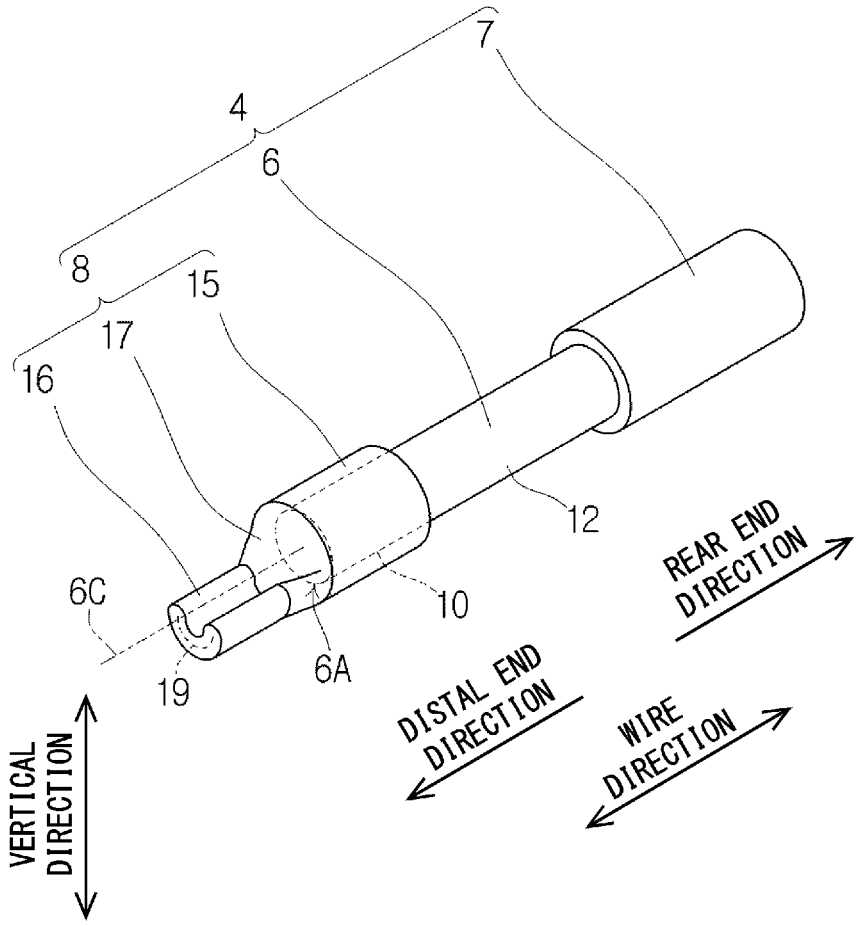
FIG. 3 is a perspective view of the wire before the terminal is attached (first embodiment)
Figure 4:
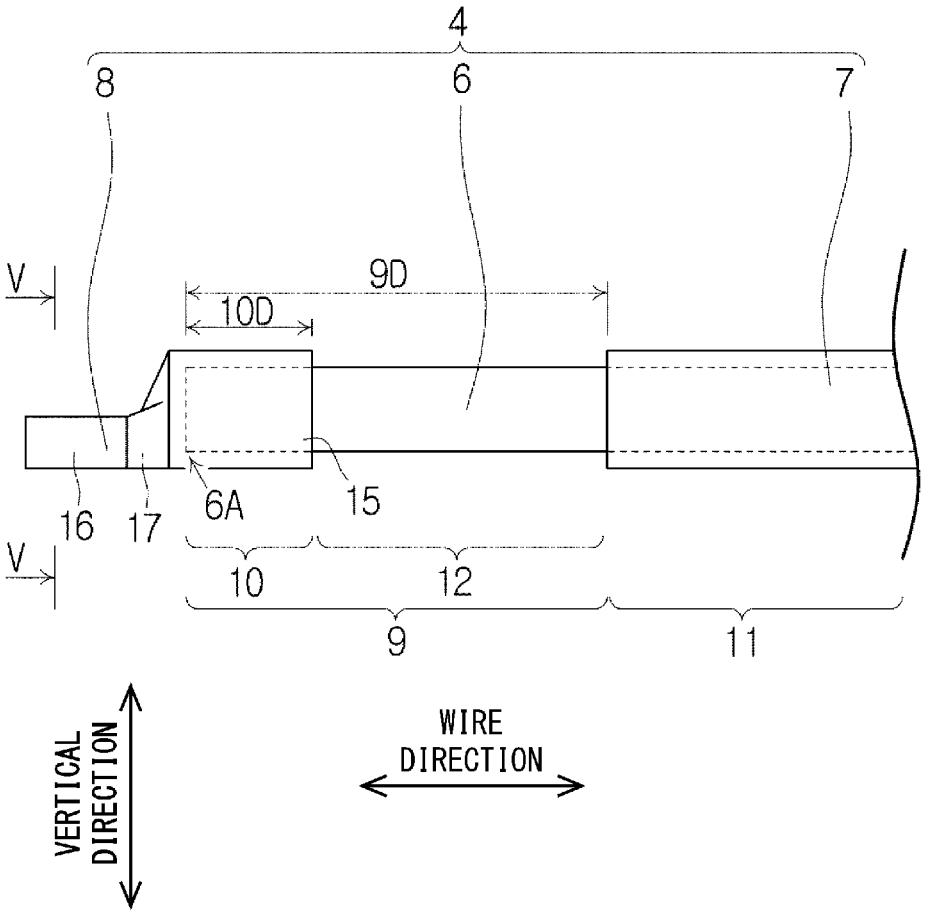
FIG. 4 is a side view of the wire before the terminal is attached (first embodiment)
Figure 5:
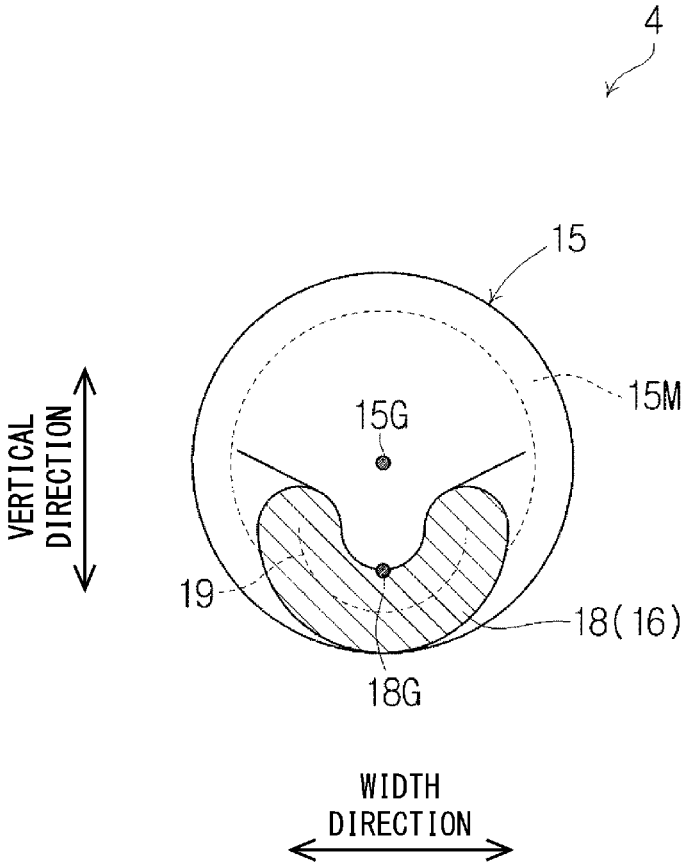
FIG. 5 is a cross-sectional diagram taken along the line V-V of FIG. 4 (first embodiment)

FIG. 3 is a perspective view of the wire 4 before the terminal 5 is attached. FIG. 4 is a side view of the wire 4 before the terminal 5 is attached. FIG. 5 is a cross-sectional diagram taken along the line V-V of FIG. 4. As shown in FIGS. 3 and 4, the wire 4 includes a core wire 6, an insulating coating 7, and a distal end seal part 8.

The core wire 6 is a stranded wire formed by twisting a plurality of element wires or a steel core aluminum stranded wire formed by twisting hard aluminum wires around a galvanized steel wire. The material of the element wire of the stranded wire is, for example, copper, aluminum, or an aluminum alloy. The element wires of the stranded wire may be plated separately. In this embodiment, the core wire 6 is a stranded wire obtained by twisting a plurality of element wires made of an aluminum alloy.

As shown in FIG. 4, the core wire 6 includes a distal end region 9. The distal end region 9 includes a distal end part 10. Both the distal end region 9 and the distal end part 10 are in the vicinity of a distal end 6A of the core wire 6. The distal end region 9 includes the distal end 6A of the core wire 6 and has a predetermined length 9D along the longitudinal direction of the wire 4. The distal end part 10 includes the distal end 6A of the core wire 6 and has a predetermined length 10D along the longitudinal direction of the wire 4. The predetermined length 9D is longer than the predetermined length 10D. That is, the distal end region 9 is longer than the distal end part 10. Thus, the distal end region 9 includes the distal end part 10. The distal end part 10 is a part of the distal end region 9. Hereinafter, the "longitudinal direction of the wire 4" is also simply referred to as a "wire direction".

In this embodiment, the material of the insulating coating 7 is the same as the material of the distal end seal part 8. Specifically, in this embodiment, both the insulating coating 7 and the distal end seal part 8 are a weldable synthetic resin such as vinyl chloride. The "weld" here includes, for example, heat-welding and ultrasonic welding.

The insulating coating 7 is tubular and covers an outer periphery of a non-distal end region 11 which is a part of the core wire 6 other than the distal end region 9.

The distal end seal part 8 is disposed separately from the insulating coating 7 in the wire direction and seals the distal end part 10 of the distal end region 9 of the core wire 6. Thus, the core wire 6 is exposed between the insulating coating 7 and the distal end seal part 8. Hereinafter, the core wire 6 exposed between the insulating coating 7 and the distal end seal part 8 is referred to as a core wire exposed part 12. The distal end region 9 is composed of the distal end part 10 and the core wire exposed part 12. As shown in FIG. 3, the distal end seal part 8 includes a distal end cover part 15, a welded part 16, and a tapered part 17. The distal end cover part 15, the tapered part 17, and the welded part 16 are connected in this recited order in a direction away from the insulating coating 7.

The distal end cover part 15 is a tubular part that covers an outer periphery of the distal end part 10. As shown in FIG. 3, in a state before the terminal 5 is attached to the wire 4, an outer diameter of the distal end cover part 15 is equal to an outer diameter of the insulating coating 7, and a thickness of the distal end cover part 15 is equal to a thickness of the insulating coating 7. However, the outer diameter of the distal end cover part 15 may become smaller or larger than the outer diameter of the insulating coating 7 at the time of welding of the welded part 16 or at the time of crimping of the terminal 5, which will be described later.

The welded part 16 and the tapered part 17 do not cover the outer periphery of the core wire 6 and are projecting from the distal end cover part 15 in a distal end direction.

The "distal end direction" here is one of the directions of the wire direction and is a direction in which the distal end seal part 8 is viewed from the insulating coating 7. Note that a "rear end direction" is the other direction of the directions of the wire direction and is a direction in which the insulating coating 7 is viewed from the distal end seal part 8.

The welded part 16 is a tubular body crushed in the vertical direction, which is an arbitrary direction orthogonal to the wire direction, and is a part where an internal space of the tubular body is closed by the welding. The welded part 16 extends linearly in the wire direction. As shown in FIG. 5, when viewed along the rear end direction, the shape of a cross section 18, which is orthogonal to the wire direction, of the welded part 16 is asymmetrical in the vertical direction and symmetrical in the width direction. The "width direction" here is a direction orthogonal to the vertical direction and the wire direction. In this embodiment, the shape of the cross section 18 of the welded part 16 is a U-shape that is convex outward in the radial direction. FIG. 5 shows a center of gravity 18G of the cross section 18 of the welded part 16 and a center of gravity 15G of a cross section 15M, which is orthogonal to the wire direction, of the distal end cover part 15. As shown in FIG. 5, when viewed along the rear end direction, the center of gravity 18G of the cross section 18 of the welded part 16 is offset from the center of gravity 15G of the cross section 15M of the distal end cover part 15, and the centers of gravity 18G and 15G do not match with each other. The center of gravity 15G is positioned in the direction in which the U-shaped cross section 18 of the welded part 16 opens. Moreover, as shown in FIG. 3, the welded part 16 is formed in such a way that a virtual extension line 6C of a central axis of the core wire 6 is avoided. Furthermore, as shown in FIGS. 3 and 5, a U-shaped welding mark 19 is left on the cross section 18 of the welded part 16. The shape of the cross section 18 of the welded part 16 may be a V-shape instead of the U-shape. The welding mark 19 appearing on the cross section 18 of the welded part 16 is formed as a result of closing the internal space of the tubular body by the welding as described above, and therefore constitutes a single continuous line.

As shown in FIG. 3, the tapered part 17 is a tubular body that smoothly connects the distal end cover part 15 to the welded part 16. The tapered part 17 is inclined to be tapered toward the distal end direction.

Hereinafter, as shown in FIGS. 1 and 2, the "wire direction", "distal end direction", "rear end direction", "vertical direction", and "width direction" defined to describe the wire 4 shall also be used for descriptions of the housing 2 and the terminal 5.

<Terminal 5>

Figure 6:
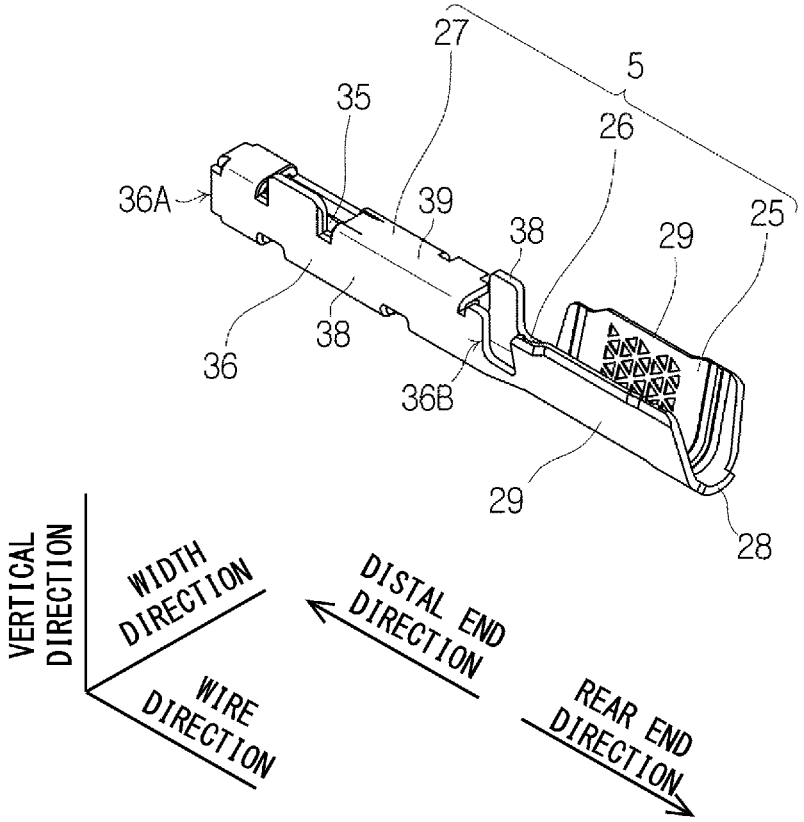
FIG. 6 is a perspective view of the terminal before the terminal is attached to the wire (first embodiment)
Figure 7:
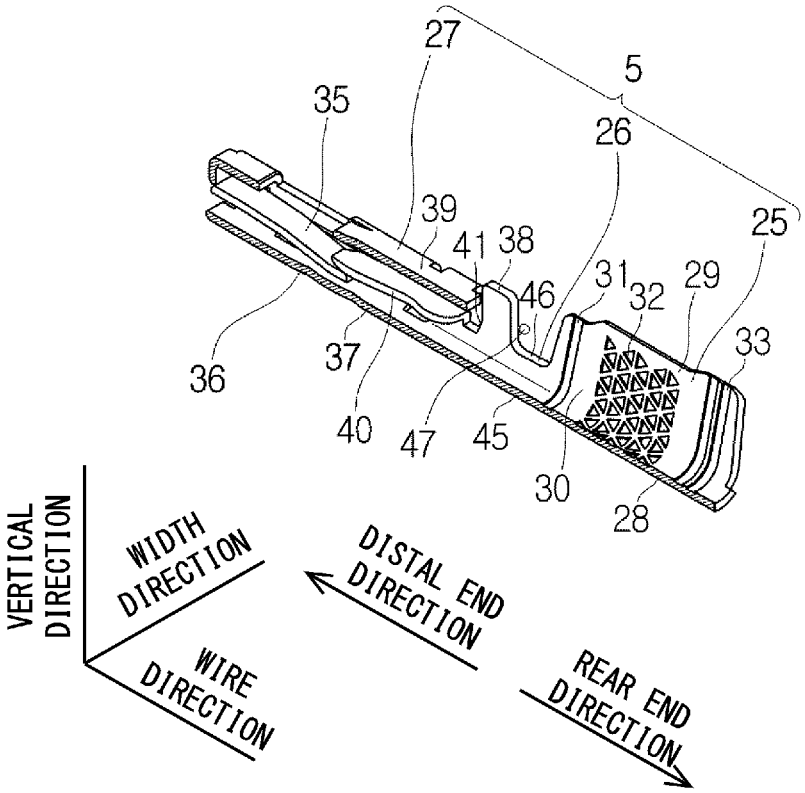
FIG. 7 is a partially cut-out perspective view of the terminal before the terminal is attached to the wire (first embodiment)
Figure 8:
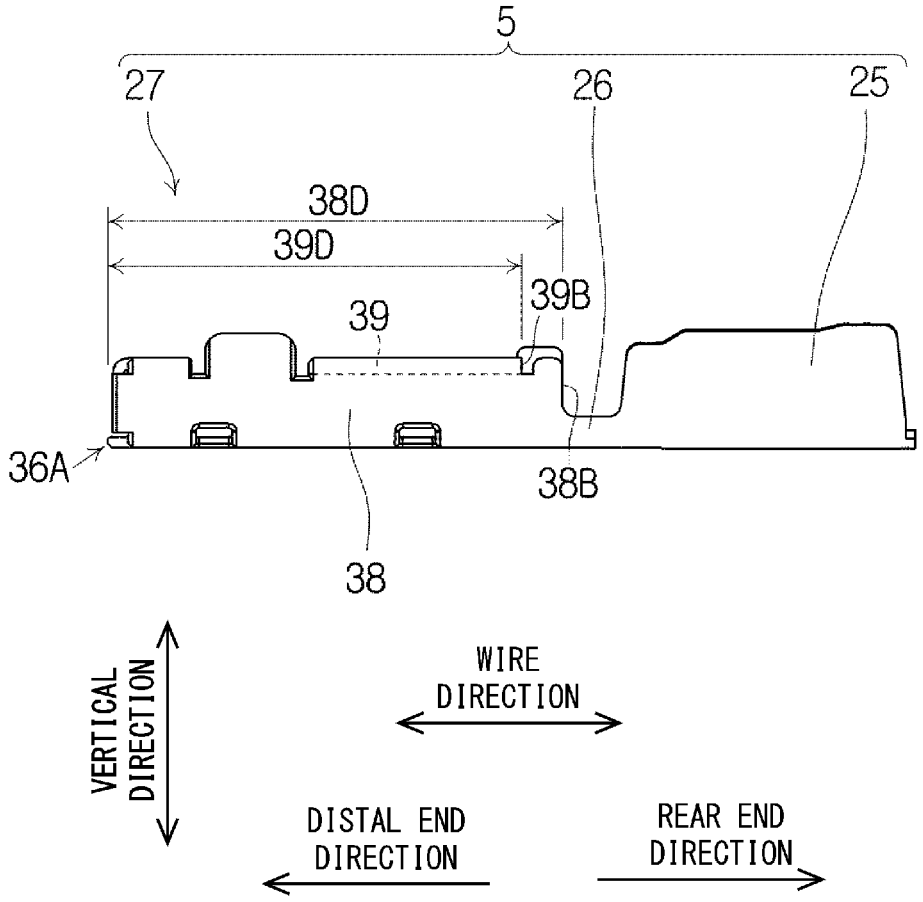
FIG. 8 is a side view of the terminal before the terminal is attached to the wire (first embodiment)

Next, the terminal 5 will be described with reference to FIGS. 6 to 8. FIG. 6 is a perspective view of the terminal 5 before the terminal 5 is attached to the wire 4. FIG. 7 is a partially cut-out perspective view of the terminal 5 before the terminal 5 is attached to the wire 4. FIG. 8 is a side view of the terminal 5 before the terminal 5 is attached to the wire 4.

As shown in FIG. 6, the terminal 5 includes a wire crimp part 25, a connecting part 26, and an electrical contact part 27. The wire crimp part 25, the connecting part 26, and the electrical contact part 27 are connected in this recited order toward the distal end direction. That is, the connecting part 26 connects the wire crimp part 25 to the electrical contact part 27.

The wire crimp part 25 is a part crimped to the wire 4. As shown in FIG. 6, in this embodiment, the wire crimp part 25 is formed in a so-called open barrel type. That is, the wire crimp part 25 includes a base plate part 28 and two crimp pieces 29. As shown in FIG. 7, the plate thickness direction of the base plate part 28 is substantially parallel to the vertical direction. Each of the two crimp pieces 29 extends upward from an end of the base plate part 28 in the width direction. Thus, when the electrical contact part 27 is viewed from the wire crimp part 25 along the wire direction, the wire crimp part 25 has a U-shape that opens upward. A distal end side serration 31, a central serration 32, and a rear end side serration 33 are formed in this recited order on an inner surface 30 of each crimp piece 29 toward the rear end direction. In this embodiment, both of the distal end side serration 31 and the rear end side serration 33 are formed in straight grooves extending in a direction orthogonal to the wire direction. Further, in this embodiment, the central serration 32 is formed of a plurality of depressions aligned in a matrix.

The electrical contact part 27 is a part electrically contactable with a mating terminal (not shown). The electrical contact part 27 includes a contact spring piece 35 and a spring protector 36 that accommodates and protects the contact spring piece 35.

As shown in FIG. 6, the spring protector 36 is a rectangle tubular body extending along the wire direction. As shown in FIGS. 6 and 7, the spring protector 36 includes a base plate part 37, two side plate parts 38, and a top plate part 39 opposed the base plate part 37. The base plate part 37 and the top plate part 39 are opposed to each other in the vertical direction. The top plate part 39 is disposed above the base plate part 37. The two side plate parts 38 are opposed to each other in the width direction. As shown in FIG. 8, a dimension 39D from a distal end 36A of the spring protector 36 to a rear end 39B of the top plate part 39 is smaller than a dimension 38D from the distal end 36A of the spring protector 36 to the rear ends 38B of the two side plate parts 38. Thus, as shown in FIG. 6, it can be said that the top plate part 39 is cut out in the vicinity of the rear end 36B of the spring protector 36. The rear ends 38B of the two side plate parts 38 shown in FIG. 8 are parts contactable with a retainer, which will be described later, in the wire direction.

As shown in FIG. 7, the contact spring piece 35 is protected by the spring protector 36 by being accommodated in the rectangle tubular spring protector 36. The contact spring piece 35 is elongated in the wire direction. The contact spring piece 35 is supported by the spring protector 36 in a cantilevered manner.

The electrical contact part 27 according to this embodiment further includes a reinforcing piece 40 for controlling deformation of the contact spring piece 35. The reinforcing piece 40 is supported by the spring protector 36 in a cantilevered manner and covers a free end of the contact spring piece 35. The reinforcing piece 40 is formed by being cut and raised from one of the side plate parts 38 shown in FIG. 7 among the two side plate parts 38. Thus, there is a notch 41 resulting from the cutting and raising of the reinforcing piece 40 in this side plate part 38.

As shown in FIG. 6, the connecting part 26 is a part that connects the wire crimp part 25 to the electrical contact part 27. As shown in FIG. 7, the connecting part 26 includes a base plate part 45 and two side plate parts 46. The plate thickness direction of the base plate part 45 is substantially parallel to the vertical direction. Each of the two side plate parts 46 extends upward from an end of the base plate part 45 in the width direction. The base plate part 45 connects the base plate part 28 of the wire crimp part 25 to the base plate part 37 of the spring protector 36 of the electrical contact part 27 in the wire direction. Likewise, each side plate part 46 connects the corresponding crimp piece 29 of the wire crimp part 25 to the corresponding side plate part 38 of the electrical contact part 27 in the wire direction. The two side plate parts 46 of the connecting part 26 are lower than the two crimp pieces 29 of the wire crimp part 25 and the two side plate parts 38 of the electrical contact part 27, which allows a retainer insertion space 47 to be left between the electrical wire crimp part 25 and the electrical contact part 27. The retainer, which will be described later, is configured to be inserted into the retainer insertion space 47.

The above-described terminal 5 is formed by, for example, plating a single thin plate made of copper or a copper alloy with a base metal such as tin, nickel, zinc or the like and then pressing it. Note that the terminal 5 may be obtained by pressing a thin plate and then plating it.

<Wire with Terminal 3>

Figure 9:
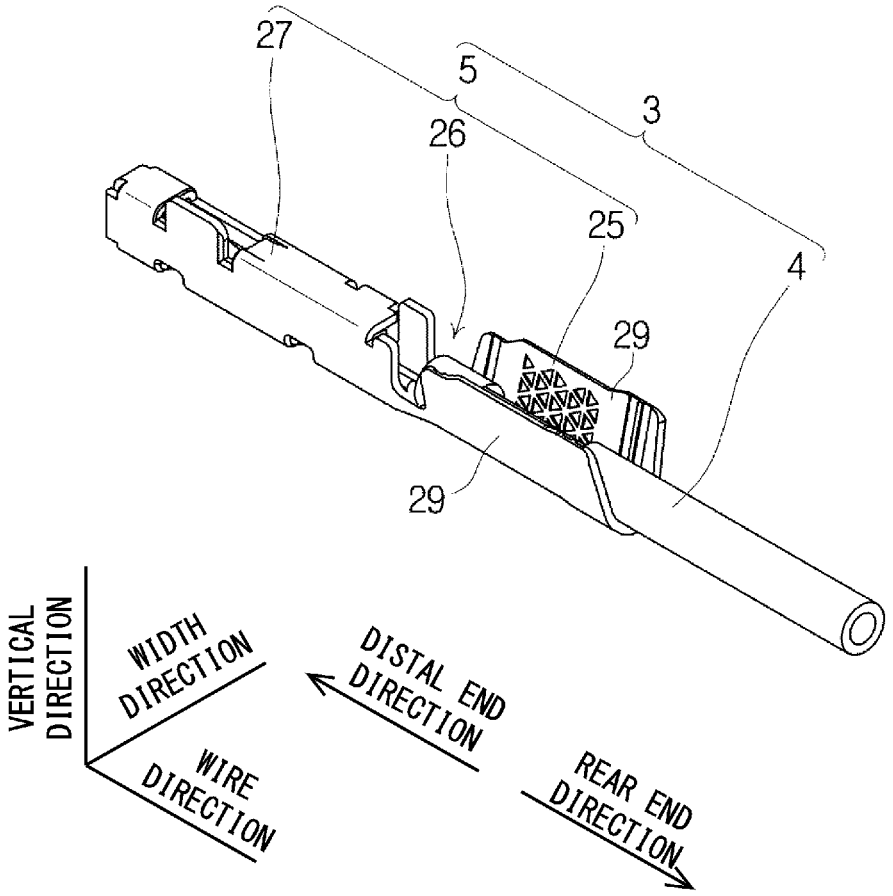
FIG. 9 is a perspective view just before the terminal is crimped to the wire (first embodiment)
Figure 10:
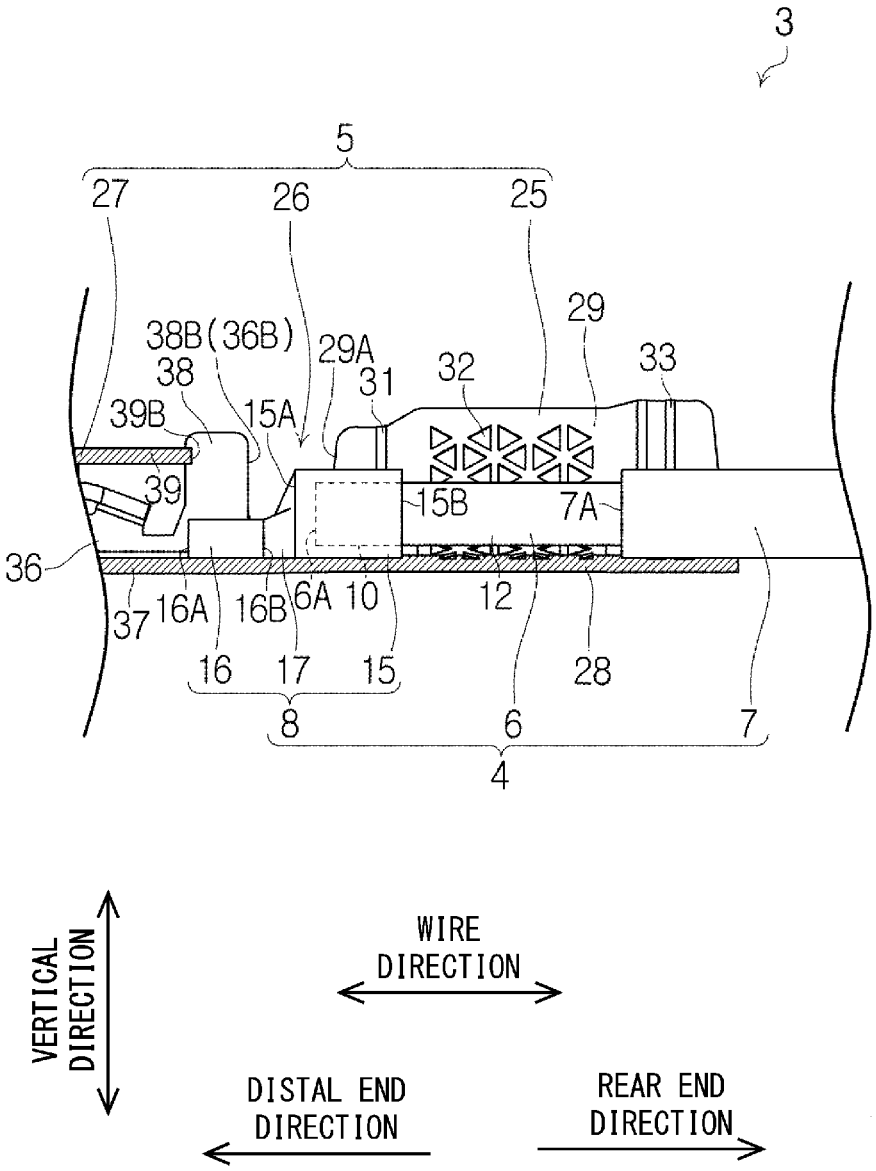
FIG. 10 is a side cross-sectional diagram just before the terminal is crimped to the wire (first embodiment)
Figure 11:
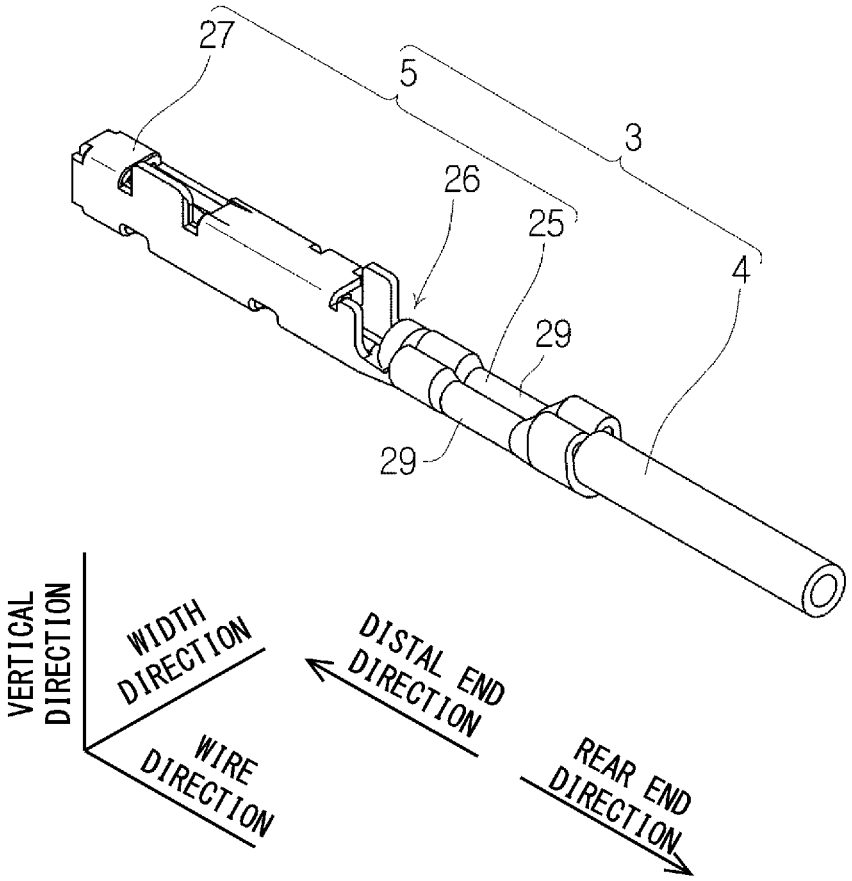
FIG. 11 is a perspective view of a state in which the terminal is crimped to the wire (first embodiment)
Figure 12:
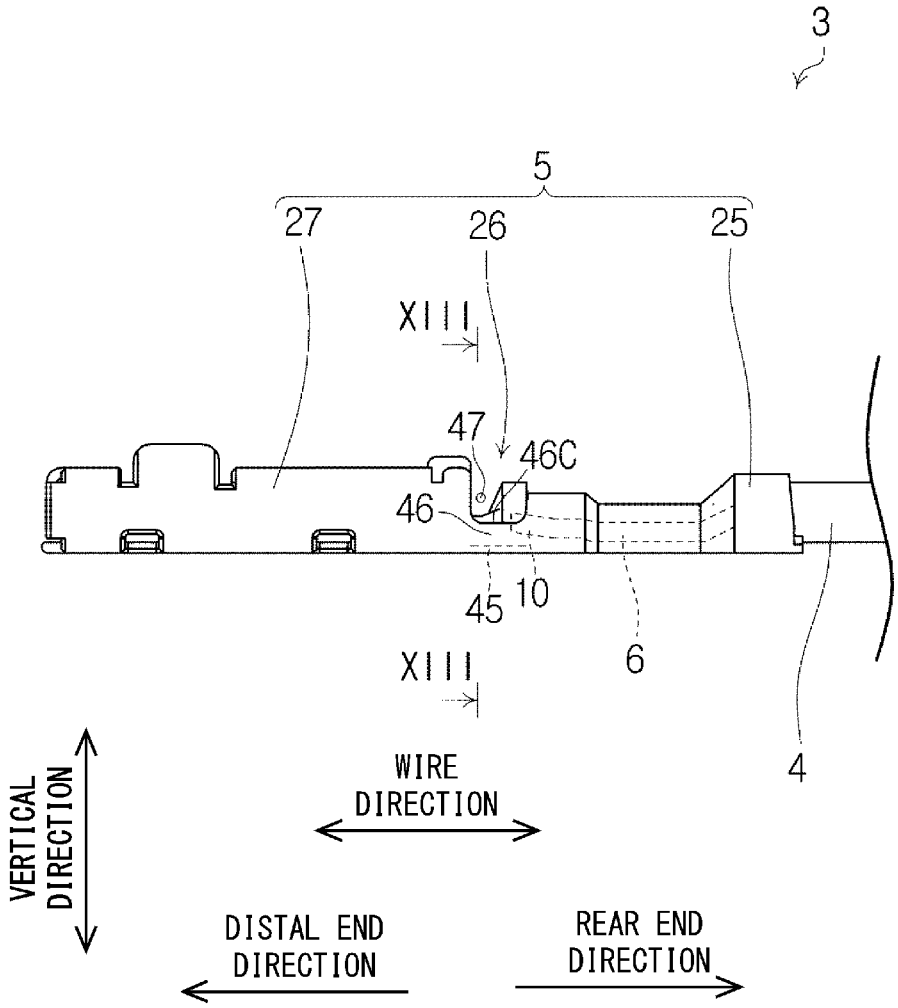
FIG. 12 is a side view of the state in which the terminal is crimped to the wire (first embodiment)
Figure 13:
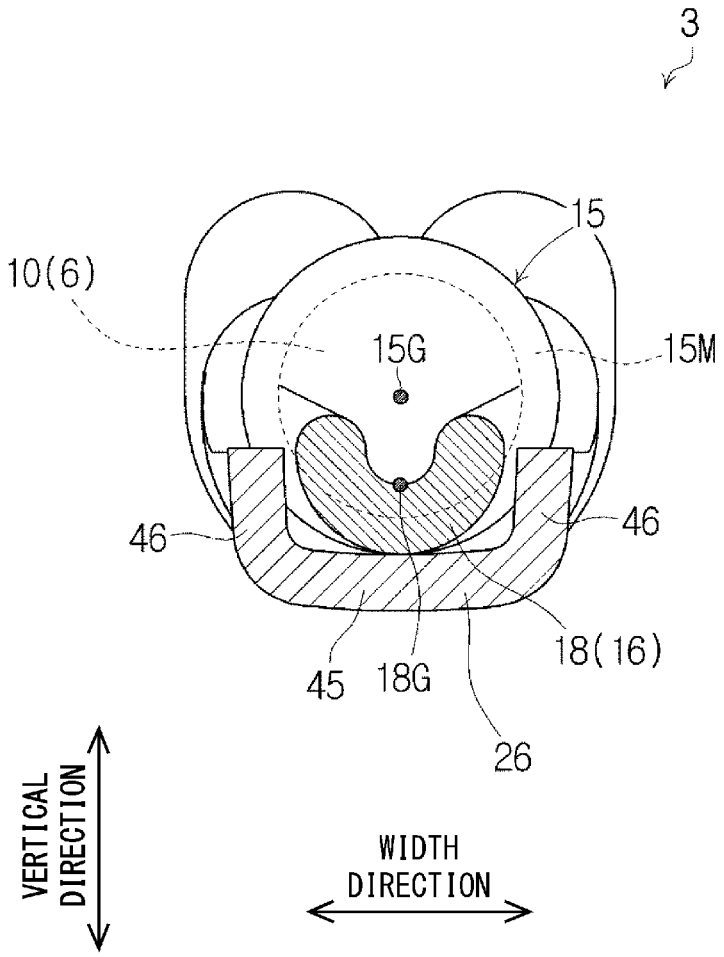
FIG. 13 is a cross-sectional diagram taken along the line XIII-XIII of FIG. 12 (first embodiment)

Next, the wire with a terminal 3 will be described with reference to FIGS. 9 to 13. FIG. 9 is a perspective view just before the terminal 5 is crimped to the wire 4. FIG. 10 is a side cross-sectional diagram just before the terminal 5 is crimped to the wire 4. FIG. 11 is a perspective view of a state in which the terminal 5 is crimped to the wire 4. FIG. 12 is a side view of a state in which the terminal 5 is crimped to the wire 4. FIG. 13 shows a cross-sectional diagram taken along the line XIII-XIII of FIG. 12.

In order to crimp the above-described terminal 5 to the wire 4, as shown in FIG. 9, firstly the wire 4 is disposed between the two crimp pieces 29 of the wire crimp part 25.

Specifically, as shown in FIG. 10, the wire 4 is disposed between the two crimp pieces 29 of the wire crimp part 25 in such a way that the following conditions are satisfied.

(1) In the wire direction, a distal end 16A of the welded part 16 is positioned between the distal end 36A (see also FIG. 6) and the rear end 36B of the spring protector 36 of the electrical contact part 27.

(2) Preferably, the distal end 16A of the welded part 16 is positioned right below the rear end 39B of the top plate part 39 of the electrical contact part 27.

(3) In the wire direction, a rear end 16B of the welded part 16 is positioned between the rear end 36B of the spring protector 36 of the electrical contact part 27 and distal ends 29A of the two crimp pieces 29 of the wire crimp part 25.

(4) In the wire direction, a distal end 15A of the distal end cover part 15 is positioned between the rear end 36B of the spring protector 36 of the electrical contact part 27 and the distal ends 29A of the two crimp pieces 29 of the wire crimp part 25.

(5) In the wire direction, the distal end 6A of the core wire 6 is positioned between the rear end 36B of the spring protector 36 of the electrical contact part 27 and the distal ends 29A of the two crimp pieces 29 of the wire crimp part 25.

(6) In the wire direction, a rear end 15B of the distal end cover part 15 is positioned between the distal end side serration 31 and the central serration 32.

(7) In the radial direction of the wire 4, the distal end cover part 15 is opposed to the distal end side serration 31.

(8) In the wire direction, the core wire exposed part 12 is positioned between the distal end side serration 31 and the rear end side serration 33.

(9) In the radial direction of the wire 4, the core wire exposed part 12 is opposed to the central serration 32.

(10) In the wire direction, the distal end 7A of the insulating coating 7 is positioned between the central serration 32 and the rear end side serration 33.

(11) In the radial direction of the wire 4, the insulating coating 7 is opposed to the rear end side serration 33.

(12) Further, the welded part 16 is disposed as close as possible to the base plate part 37 of the spring protector 36 of the electrical contact part 27.

After the wire 4 is disposed between the two crimp pieces 29 of the wire crimp part 25 as described above, as shown in FIGS. 11 and 12, the two crimp pieces 29 of the wire crimp part 25 of the terminal 5 are crimped to the wire 4 using a dedicated crimp tool. Specifically, each crimp piece 29 is crimped to the distal end cover part 15 of the distal end seal part 8, the core wire exposed part 12, and the insulating coating 7 of the wire 4 shown in FIG. 10. Further, at the time of the crimping, the two crimp pieces 29 are plastically deformed inward in such a way that the two crimp pieces 29 are brought into close contact with each other. Then, the distal end cover part 15 bites into the distal end side serration 31 of each crimp piece 29 shown in FIG. 10, and the insulating coating 7 bites into the rear end side serration 33 of each crimp piece 29, so that the core wire exposed part 12 can be sealed by the wire crimp part 25, the distal end cover part 15, and the insulating coating 7, and the shape shown in FIG. 2 is obtained. Further, the central serration 32 bites into the core wire exposed part 12 to thereby locally remove a passive film of the core wire 6, and satisfactory conduction between the terminal 5 and the core wire 6 can be established. Note that the distal end 6A of the core wire 6 is sealed by closing the welded part 16 of the distal end seal part 8 by welding.

Here, as shown in FIG. 12, in this embodiment, a part of the distal end 6A of the core wire 6 is positioned above the connecting part 26 between the electrical contact part 27 and the wire crimp part 25. That is, in this embodiment, the part of the distal end 6A of the core wire 6 is positioned above upper ends 46C of the two side plate parts 46 of the connecting part 26 between the electrical contact part 27 and the wire crimp part 25. In other words, the part of the distal end 6A of the core wire 6 is positioned farther from the base plate part 45 than the upper ends 46C are. Such a configuration enables a confirmation that the distal end 6A of the core wire 6 is positioned between the electrical contact part 27 and the wire crimp part 25 after the crimping by emitting X-rays on the wire with a terminal 3 in the width direction.

Further, as shown in FIG. 13, in this embodiment, when the wire crimp part 25 is viewed from the electrical contact part 27 along the wire direction, the center of gravity 18G of the cross section 18, which is orthogonal to the wire direction, of the welded part 16 is positioned between the center of gravity 15G of the cross section 15M, which is orthogonal to the wire direction, of the distal end cover part 15 and the base plate part 45 of the connecting part 26 in the vertical direction. According to the above configuration, as shown in FIG. 12, the retainer insertion space 47 into which the retainer is inserted can be effectively left between the electrical contact part 27 and the wire crimp part 25. The retainer will be described later in detail.

<Harness 1>

Figure 14:
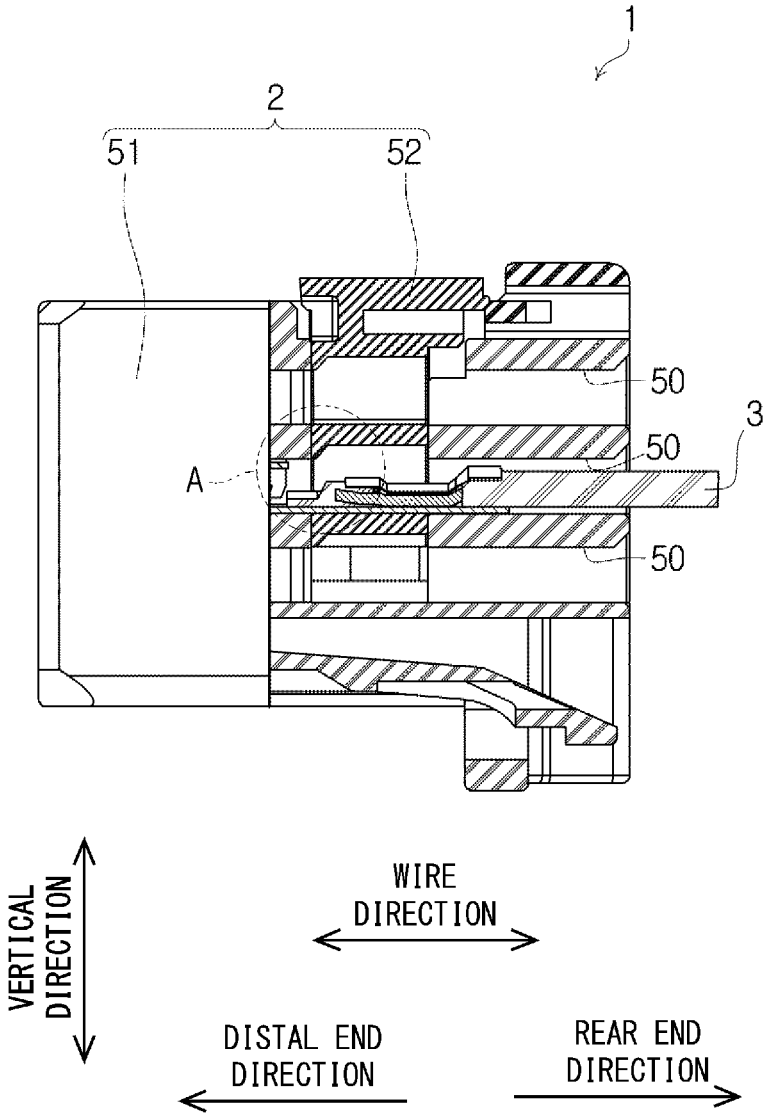
FIG. 14 is a partially cut-out side view of the harness before secondary locking (first embodiment)
Figure 15:
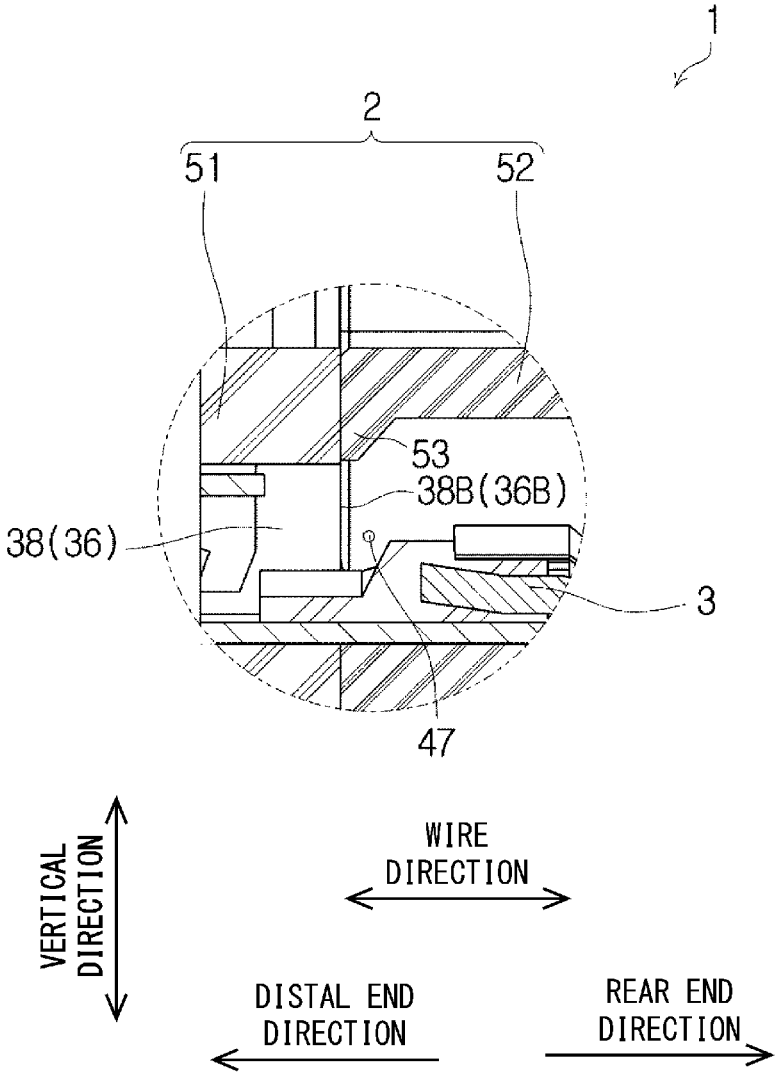
FIG. 15 is an enlarged view of a part A of FIG. 14 (first embodiment)
Figure 16:
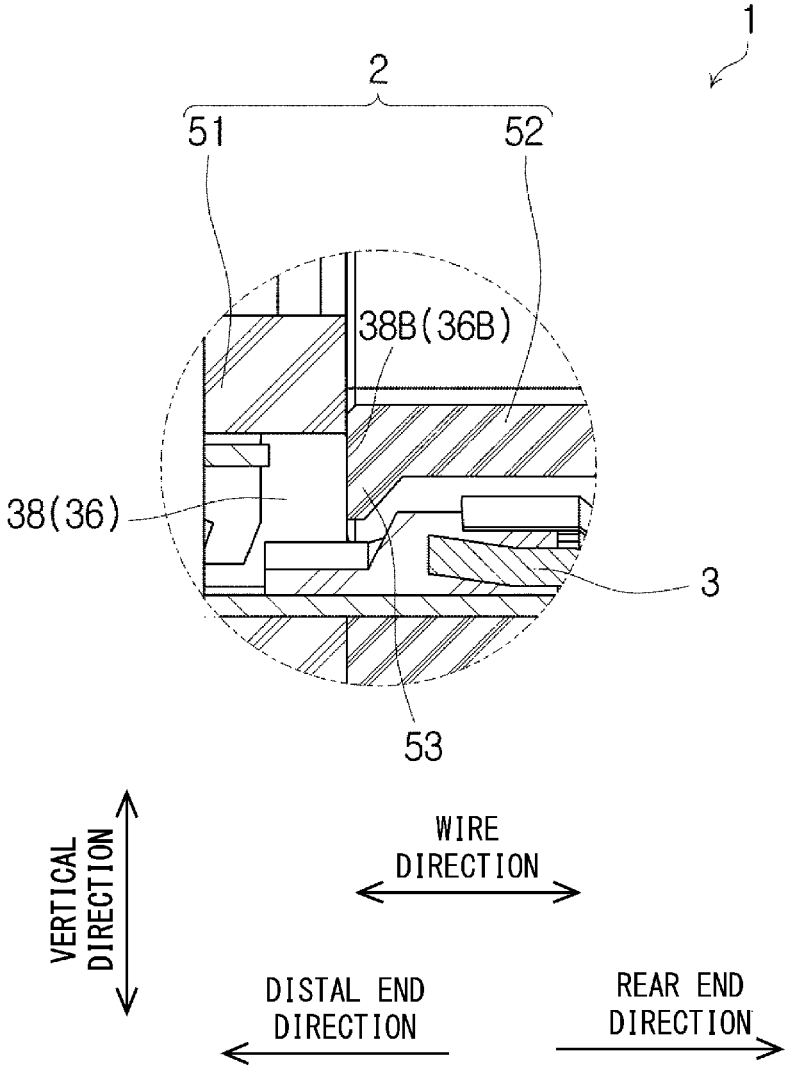
FIG. 16 shows the harness in a secondary locking state (first embodiment)

Next, the harness 1 will be described with reference to FIGS. 14 to 16. FIG. 14 is a partially cut-out side view of the harness 1 before secondary locking. FIG. 15 is an enlarged view of a part A of FIG. 14. FIG. 16 shows the harness 1 in a secondary locking state.

As shown in FIG. 14, the housing 2 includes a housing main body 51 and a retainer 52. The housing main body 51 includes a plurality of cavities 50 into which the respective wires with a terminal 3 can be inserted in the wire direction. The retainer 52 is for the secondary locking. The retainer 52 is held movably in the vertical direction with respect to the housing main body 51.

As shown in FIGS. 15 and 16, the retainer 52 includes a lock claw 53 which can be inserted into the retainer insertion space 47 of the wire with a terminal 3. As shown in FIGS. 15 and 16, when the retainer 52 is lowered, the lock claw 53 is inserted into the retainer insertion space 47 of the wire with a terminal 3, and the lock claw 53 is in a state capable of being in contact with the rear end 36B of the spring protector 36 in the wire direction. In other words, when the retainer 52 is lowered, the lock claw 53 is in a state capable of being in contact with the rear end 38B of each side plate part 38 of the spring protector 36 in the wire direction. Then, even when the wire with a terminal 3 is to be pulled out of the housing 2, the rear end 36B of the spring protector 36 is caught on the lock claw 53, and the pulling-out of the wire with a terminal 3 from the housing 2 is prohibited.

<Method of Manufacturing Terminal with Wire 3>

Figure 17:
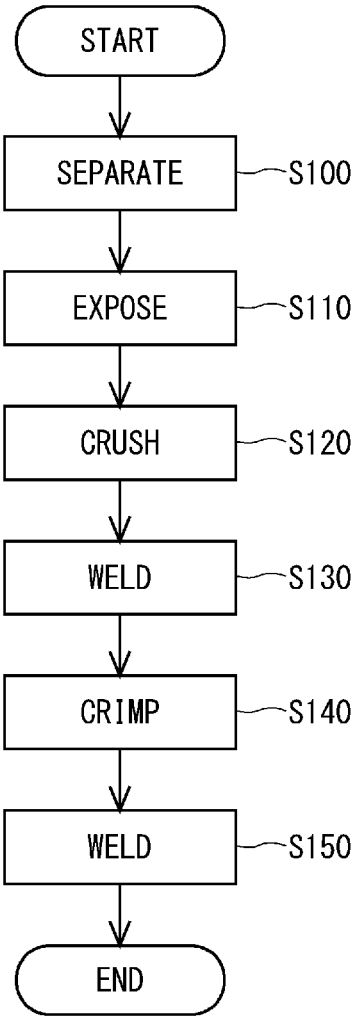
FIG. 17 is a flowchart of a method of manufacturing a wire with a terminal (first embodiment)

Next, a method of manufacturing the wire 4 and, further, a method of manufacturing the wire with a terminal 3 will be described with reference to FIGS. 17 to 19C. FIG. 17 is a flowchart of the method of manufacturing the wire with a terminal 3. FIGS. 18A, 18B, 18C, 19A, 19B, and 19C are diagrams for describing each step of the method of manufacturing the wire with a terminal 3. However, in FIGS. 19B and 19C, the connecting part 26 and the electrical contact part 27 of the terminal 5 are not shown for convenience of the description. Hereinafter, descriptions will be made with reference to the flowchart shown in FIG. 17.

(Separation Process: S100)

Figure 18A:
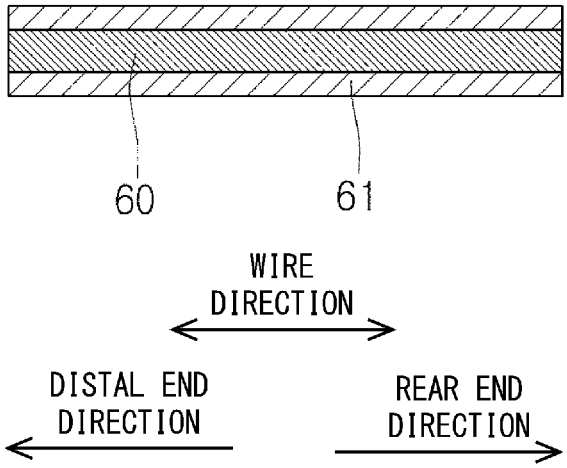
FIG. 18A is a diagram for describing each step of the method of manufacturing the wire with a terminal (first embodiment)
Figure 18B:
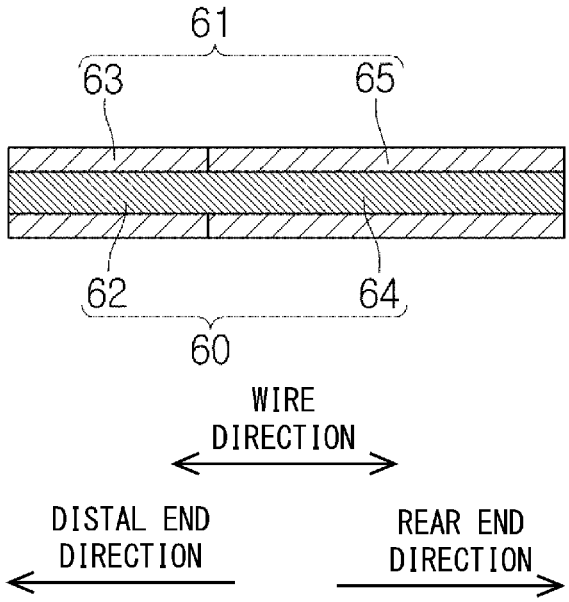
FIG. 18B is a diagram for describing each step of the method of manufacturing the wire with a terminal (first embodiment)

FIG. 18A shows the wire 4 cut at a predetermined place. First, as shown in FIG. 18B, in order to enable the terminal 5 to be attached to this wire 4, an insulating coating 61 that covers a core wire 60 is cut, thereby separating the insulating coating 61 into a distal end side coating 63 (first insulating coating) that covers a distal end region 62 of the core wire 60 and a rear end side coating 65 (second insulating coating) that covers a rear end region 64 which is a part of the core 60 other than the distal end region 62.

(Exposure Process: S110)

Figure 18C:
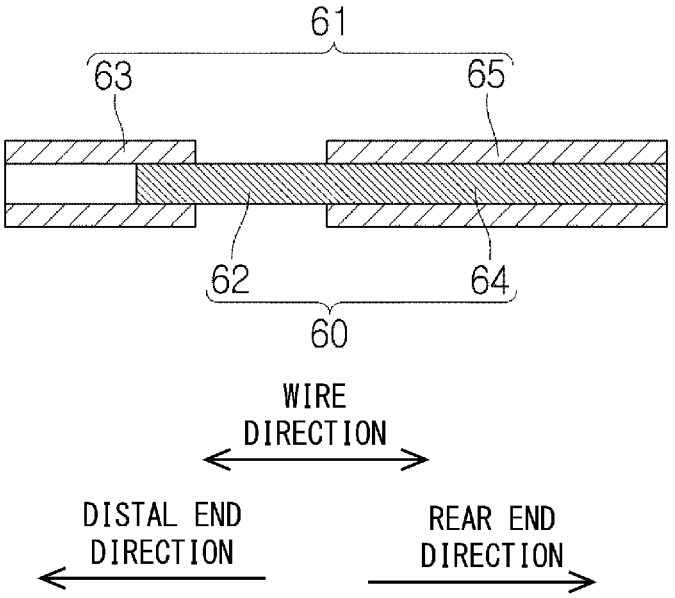
FIG. 18C is a diagram for describing each step of the method of manufacturing the wire with a terminal (first embodiment)

Next, as shown in FIG. 18C, the distal end side coating 63 is slid on the core wire 60 to move the distal end side coating 63 in a direction away from the rear end side coating 65, so that the core wire 60 is exposed between the distal end side coating 63 and the rear end side coating 65.

(Crushing Process: S120)

Figure 19A:
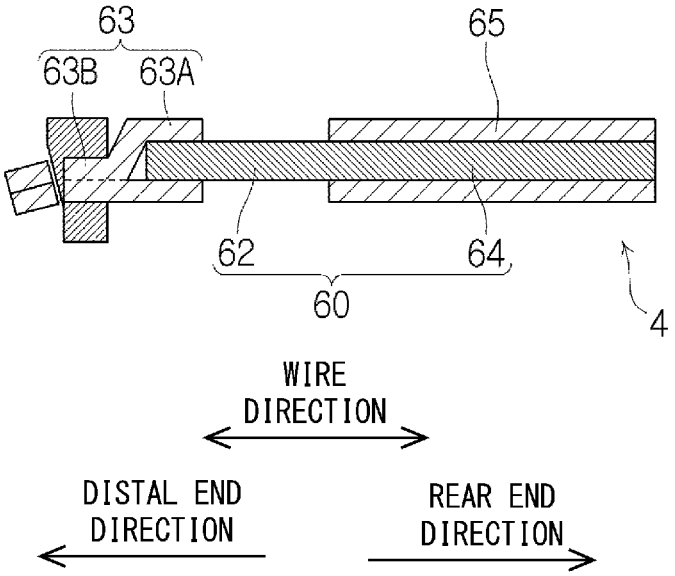
FIG. 19A is a diagram for describing each step of the method of manufacturing the wire with a terminal (first embodiment)

Next, as shown in FIG. 19A, an excess part 63B of the distal end side coating 63 other than a part 63A that covers the outer periphery of the core wire 60 is crushed in the orthogonal direction that is orthogonal to the longitudinal direction of the core wire 60. At the same time, a distal end of the excess part 63B is cut as necessary.

(Welding Process: S130)

At the same time as the above crushing process or after the above crushing process, the crushed excess part 63B is closed by welding. The welding may be either heat-welding or ultrasonic welding. In this way, the wire 4 that can be attached to the terminal 5 is completed. Note that in FIG. 19A and subsequent diagrams, the welding mark as a mark of the closure caused by the welding is roughly drawn by a broken line. This welding mark appears on the cross section as a slightly unclear single line. Further, FIG. 19A shows the case in which the welding is performed after the distal end of the excess part 63B is cut. Alternatively, the distal end of the excess part 63B may be cut after the welding.

(Crimping Process: S140)

Figure 19B:
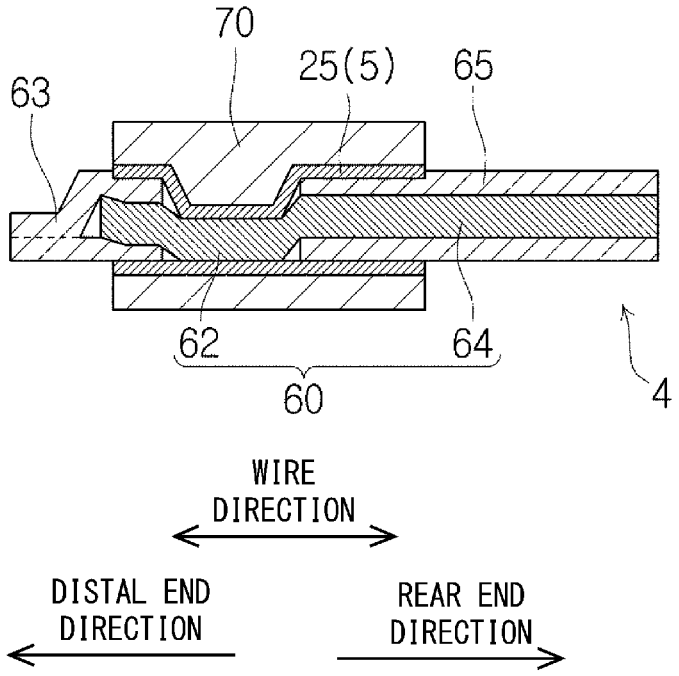
FIG. 19B is a diagram for describing each step of the method of manufacturing the wire with a terminal (first embodiment)

Next, as shown in FIG. 19B, the wire crimp part 25 of the terminal 5 is crimped to the wire 4 using a crimp tool 70.

(Welding Process: S150)

Figure 19C:
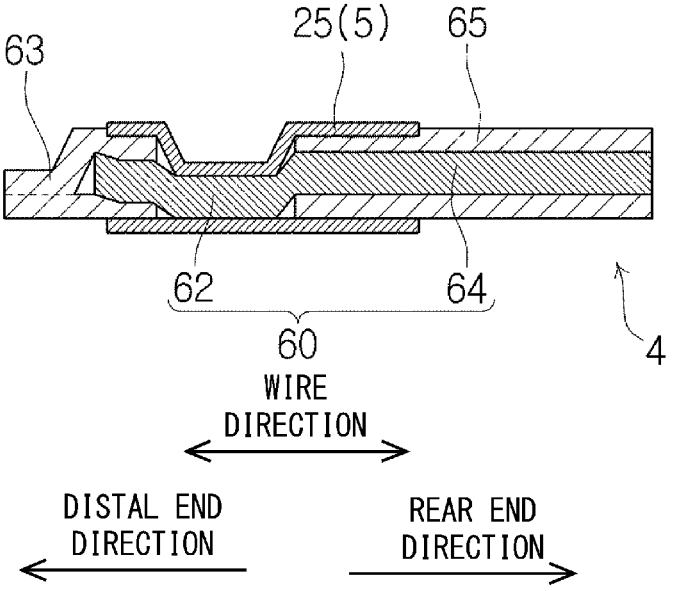
FIG. 19C is a diagram for describing each step of the method of manufacturing the wire with a terminal (first embodiment)

By heating the wire crimp part 25 of the terminal 5 simultaneously with or around the time of the crimping process, the adhesion between the distal end side coating 63 and the wire crimp part 25 and the adhesion between the rear end side coating 65 and the wire crimp part 25 improve. In this way, as shown in FIG. 19C, the terminal 5 is attached to the wire 4, so that the wire with a terminal 3 is completed.

The welding process (S130) may be performed simultaneously with or after the crimping process (S140) instead of performing the crimping process (S130) before the crimping process (S140). In this embodiment, as shown in FIG. 10, although the welded part 16 is positioned in the spring protector 36, the rear end 39B of the top plate part 39 is positioned on the distal end direction side as compared with the rear ends 38B of the side plate parts 38, which makes it possible to form the welded part 16 even after the terminal 5 is attached to the wire 4 by heating the excess part 63B while pushing it against the connecting part 26 using a welding tool. Note that when the welding process (S130) is performed simultaneously with or after the crimping process (S140), a lower surface shape of the welded part 16 is along the inner surface of the connecting part 26.

The first embodiment has been described so far. The above-described first embodiment has the following features.

That is, as shown in FIGS. 3 and 4, the wire 4 includes the core wire 6, the insulating coating 7 that covers the outer periphery of the non-distal end region 11 as a part of the core wire 6 other than the distal end region 9, and the distal end seal part 8 that is disposed separately from the insulating coating 7 and seals the distal end part 10 of the distal end region 9 of the core wire 6. The core wire 6 is exposed between the distal end seal part 8 and the insulating coating 7. The distal end seal part 8 includes the tubular distal end cover part 15 that covers the outer periphery of the distal end part 10 and the welded part 16 that is crushed in the orthogonal direction (cross direction) orthogonal to (crossing) the wire direction (longitudinal direction of the wire) and is closed by the welding. With such a configuration, the distal end part 10 of the core wire 6 can be reliably sealed. Moreover, the welded part 16 that is compact in the orthogonal direction orthogonal to the wire direction can be achieved.

Further, as shown in FIG. 5, the center of gravity 18G of the cross section 18, which is orthogonal to the wire direction, of the welded part 16 is offset from the center of gravity 15G of the cross section 15M, which is orthogonal to the wire direction, of the distal end cover part 15. According to the above configuration, the large retainer insertion space 47 can be formed above the welded part 16 by disposing the welded part 16 at a lower part. Thus, a sufficient distance in the vertical direction that enables the lock claw 53 of the retainer 52 to be in contact with the rear ends 38B of the side plate parts 38 can be obtained, which further prevents the wire with a terminal 3 from coming off the housing 2.

Moreover, as shown in FIGS. 3 and 5, the shape of the cross section 18, which is orthogonal to the wire direction, of the welded part 16 is a U-shape. According to the above configuration, it is possible to make the dimension of the welded part 16 in the width direction compact even while the welded part 16 is crushed in the vertical direction.

Moreover, as shown in FIG. 3, the welded part 16 is formed to avoid the virtual extension line 6C of the central axis of the core wire 6. According to the above configuration, a space can be left above the welded part 16 by disposing the welded part 16 at a lower part, and thus a physical interference between the welded part 16 and the retainer 52 can be avoided.

Although the "cross direction" is described as a direction orthogonal to the wire direction in the above embodiments, it may be a direction crossing the wire direction at an angle other than 90 degrees.

Further, as shown in FIGS. 9 to 12, the wire with a terminal 3 includes the wire 4 and the terminal 5 attached to the wire 4. The terminal 5 includes the electrical contact part 27 electrically contactable with the mating terminal; the wire crimp part 25 crimped to the wire 4, and the connecting part 26 that connects the electrical contact part 27 to the wire crimp part 25. The wire crimp part 25 includes the pair of crimp pieces 29. The core wire exposed part 12 is sealed by each crimp piece 29 being crimped to the distal end cover part 15 of the distal end seal part 8, the core wire exposed part 12, and the insulating coating 7.

Further, as shown in FIG. 13, when the wire crimp part 25 is viewed from the electrical contact part 27 along the wire direction, the center of gravity 18G of the cross section 18, which is orthogonal to the wire direction in the vertical direction, of the welded part 16 is positioned between the center of gravity 15G of the cross section 15M, which is orthogonal to the wire direction, of the distal end cover part 15 and the connecting part 26. According to the above configuration, as shown in FIG. 12, the large retainer insertion space 47 can be left between the electrical contact part 27 and the wire crimp part 25 and above the welded part 16.

Furthermore, as shown in FIG. 7, the electrical contact part 27 includes the contact spring piece 35 that can be in contact with the mating terminal, and the spring protector 36 that accommodates and protects the contact spring piece 35. As shown in FIGS. 6 and 10, the distal end 16A of the welded part 16 is positioned between the distal end 36A and the rear end 36B of the spring protector 36. According to the above configuration, the terminal 5 can be more compact in the wire direction as compared with the case where the distal end 16A of the welded part 16 is positioned between the electrical contact part 27 and the wire crimp part 25.

Further, as shown in FIGS. 6 and 7, the spring protector 36 has a rectangle tubular shape that includes the base plate part 37 connected to the connecting part 26, two side plate parts 38, and a top plate part 39 opposed to the base plate part 37. As shown in FIG. 8, the dimension 39D from the distal end 36A of the spring protector 36 to the rear end 39B of the top plate part 39 is smaller the dimension 38D from the distal end 36A of the spring protector 36 to the rear ends 38B of the two side plate parts 38. The above configuration makes it possible to easily visually confirm the welded part 16 inserted into the spring protector 36. It further enables the welded part 16 to be formed after the terminal 5 is crimped to the wire 4.

Further, as shown in FIG. 12, at least a part of the core wire 6 is positioned above the connecting part 26 between the electrical contact part 27 and the wire crimp part 25. This configuration makes it possible to confirm that the distal end part 10 of the core wire 6 has reached between the wire crimp part 25 and the electrical contact part 27 by using X-rays or ultrasonic wave after the crimping.

Moreover, as shown in FIG. 1, the harness 1 includes the wire with a terminal 3 and the housing 2 that accommodates the wire with a terminal 3. As shown in FIG. 16, the housing 2 includes the retainer 52 that can be in contact with the rear end 36B of the spring protector 36 in the wire direction.

Furthermore, as shown in FIGS. 17 to 19C, in the method of manufacturing the wire 4 includes the step (S100) for cutting the insulating coating 61 that covers the core wire 60 to thereby separate the insulating coating 61 into the distal end side coating 63 (first insulating coating) that covers the distal end region 62 of the core wire 6 and the rear end side coating 65 (second insulating coating) that covers the rear end region 64 which is a part of the core wire 6 other than the distal end region 62, a step (S110) for moving the distal end side coating 63 in a direction away from the rear end side coating 65 to thereby expose the core wire 60 between the distal end side coating 63 and the rear end side coating 65, and a step (S120) for crushing the excess part 63B that is a part of the distal end side coating 63 other than the part covering the outer periphery of the core wire 60 in the direction orthogonal to (the cross direction that crosses) the longitudinal direction of the core wire 60, and a step (S130) for closing the crushed excess part 63B by welding. This configuration enables the distal end part of the core wire 60 to be reliably sealed. This achieves the welded part with a compact dimension in the orthogonal direction orthogonal to the wire direction.

The crushing step (S120) and the closing step (S130) may be performed simultaneously. By doing so, the time required for manufacturing the wire 4 can be shortened.

Second Embodiment

Figure 20:
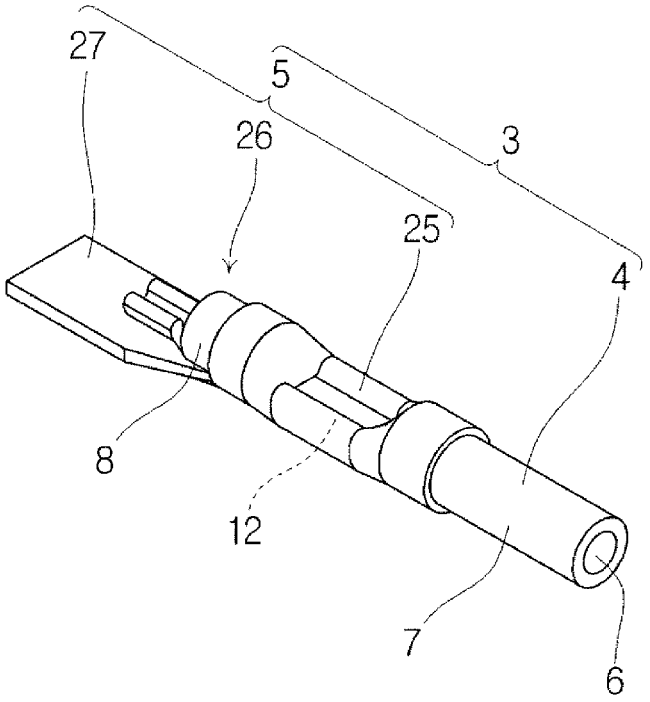
FIG. 20 is a perspective view of a wire with a terminal (second embodiment)
Figure 21:
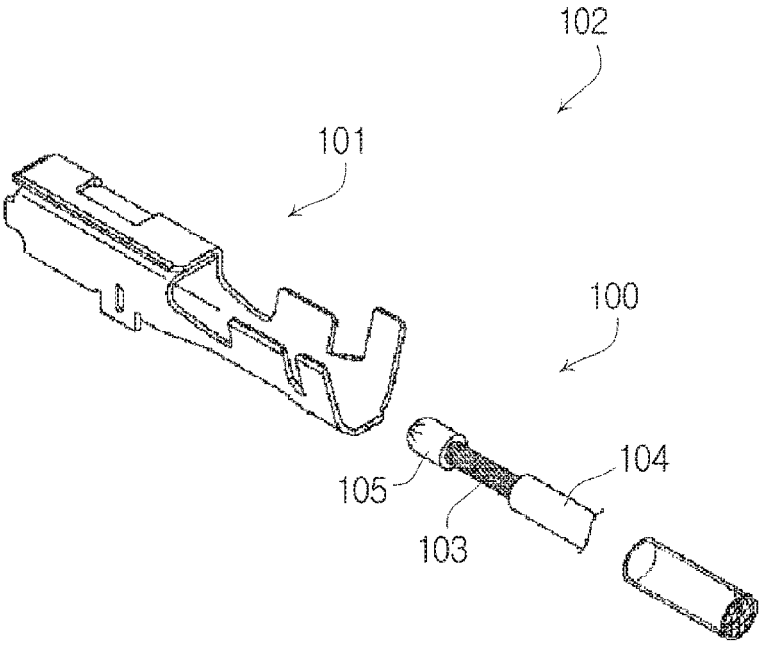
Fig. 21 (prior art)
FIG. 21 is a diagram showing a simplified FIG. 5 of Patent Literature 1.

Next, a second embodiment will be described with reference to FIG. 20. Hereinafter, a difference between this embodiment and the first embodiment will be described, and the repeated description will be omitted. FIG. 20 is a perspective view of the wire with a terminal 3. In FIG. 20, the electrical contact part 27 of the terminal 5 is not shown for convenience of the description.

In the first embodiment, for example, as shown in FIG. 6, the so-called open barrel type terminal 5 including two crimp pieces 29 is employed. Alternatively, as shown in FIG. 20, in this embodiment, a so-called closed barrel type terminal 5 in which the wire crimp part 25 is a cylinder is employed. Also in this case, the core wire exposed part 12 of the core wire 6 is sealed by the wire crimp part 25 being crimped to the core wire 6 and is also crimped to the distal end seal part 8 and the insulating coating 7. Note that the shape of the wire crimp part 25 may be a rectangle tubular shape instead of a cylinder shape as long as it has a tubular shape.

The present application is based upon and claims the benefit of priority from Japanese Patent Application No. 2017-105558, filed on May 29, 2017, the entire contents of which are hereby incorporated by reference.

The invention claimed is:

1. A wire comprising:

a core wire;

an insulating coating that covers an outer periphery of a part of the core wire other than a distal end region; and a distal end seal part that is disposed separately from the insulating coating and seals a distal end part of the distal end region of the core wire, wherein the core wire is exposed between the distal end seal part and the insulating coating, a wire crimp part that is crimped to the wire, wherein the wire crimp part comprises one or more serrations formed on an inner surface of the wire crimp part;

the distal end seal part comprises:

a tubular distal end cover part that covers an outer periphery of the distal end part; and a welded part that is crushed in a cross direction crossing a longitudinal direction of the wire and is closed by welding; the welded part being provided as crushed prior to coupling the wire with a terminal;

wherein a shape of the cross section, which is orthogonal to the longitudinal direction of the wire, of the welded part is one of a U-shape or a V-shape.

2. The wire according to claim 1, wherein a center of gravity of a cross section, which is orthogonal to the longitudinal direction of the wire, of the welded part is offset from a center of gravity of a cross section, which is orthogonal to the longitudinal direction of the wire, of the distal end cover part.

3. The wire according to claim 1, wherein the welded part is formed to avoid a virtual extension line of a central axis of the core wire.

4. The wire according to claim 1, wherein the cross direction is a direction orthogonal to the longitudinal direction of the wire.

5. A wire with a terminal comprising:

a wire comprising:

a core wire;

an insulating coating that covers an outer periphery of a part of the core wire other than a distal end region; and a distal end seal part that is disposed separately from the insulating coating and seals a distal end part of the distal end region of the core wire, wherein the core wire is exposed between the distal end seal part and the insulating coating, and a length of the exposed core wire is greater than a length of the distal end seal part, the distal end seal part comprises:

a tubular distal end cover part that covers an outer periphery of the distal end part; and a welded part that is crushed in a cross direction crossing a longitudinal direction of the wire and is closed by welding; and a terminal attached to the wire, wherein the terminal comprises:

an electrical contact part electrically contactable with a mating terminal;

a wire crimp part that is crimped to the wire, wherein the wire crimp part comprises one or more serrations formed on an inner surface of the wire crimp part; and a connecting part that connects the electrical contact part to the wire crimp part, the wire crimp part includes a pair of crimp pieces each being crimped to the distal end cover part of the distal end seal part and to the insulating coating, the core wire exposed between the distal end seal part and the insulating coating, thereby sealing the exposed core wire, or the wire crimp part is tubular and crimped to the distal end cover part of the distal end seal part and to the insulating coating, the core wire exposed between the distal end seal part and the insulating coating, thereby sealing the exposed core wire;

the electrical contact part comprises:

a contact spring piece contactable with the mating terminal; and a spring protector that accommodates and protects the contact spring piece, and a distal end of the welded part is positioned between a distal end and a rear end of the spring protector.

6. The wire with a terminal according to claim 5, wherein the spring protector has a rectangle tubular shape including a base plate part connected to the connecting part, two side plate parts, and a top plate parts opposed the base plate part, and a dimension from the distal end of the spring protector to a rear end of the top plate part is smaller than a dimension from the distal end of the spring protector to rear ends of the two side plate parts.

7. The wire with a terminal according to claim 5, wherein at least a part of the core wire is positioned above the connecting part between the electrical contact part and the wire crimp part.

8. A harness comprising:

the wire with a terminal according to claim 5; and a housing that accommodates the terminal, wherein the housing includes a retainer contactable with the rear end of the spring protector in the longitudinal direction of the wire.

9. The wire with a terminal according to claim 5, wherein when the wire crimp part is viewed from the electrical contact part along the longitudinal direction of the wire, a center of gravity of a cross section, which is orthogonal to the longitudinal direction of the wire, of the welded part is positioned between a center of gravity of a cross section, which is orthogonal to the longitudinal direction of the wire, of the distal end cover part and the connecting part.

* * * * *